US006425733B1

(12) United States Patent
Ross

(10) Patent No.: US 6,425,733 B1
(45) Date of Patent: Jul. 30, 2002

(54) TURBINE FUEL PUMP

(75) Inventor: Joseph M. Ross, Millington, MI (US)

(73) Assignee: Walbro Corporation, Cass City, MI (US)

( * ) Notice: Subject to any disclaimer, the term of this patent is extended or adjusted under 35 U.S.C. 154(b) by 8 days.

(21) Appl. No.: 09/658,903

(22) Filed: Sep. 11, 2000

(51) Int. Cl.[7] ..... F04D 5/00
(52) U.S. Cl. ..... 415/55.1
(58) Field of Search ..... 415/55.1, 55.2, 415/55.3, 55.4, 55.5

(56) References Cited

U.S. PATENT DOCUMENTS

| | | | | | |
|---|---|---|---|---|---|
| 2,042,499 | A | * | 6/1936 | Brady | 415/55.1 |
| 5,257,916 | A | | 11/1993 | Tuckey | 415/55.2 |
| 5,407,318 | A | | 4/1995 | Ito et al. | 415/55.1 |
| 5,513,950 | A | | 5/1996 | Yu | 415/55.1 |
| 5,527,149 | A | | 6/1996 | Moss et al. | 415/55.1 |
| 5,549,446 | A | | 8/1996 | Gaston et al. | 415/55.1 |
| 5,586,858 | A | * | 12/1996 | Tuckey | 415/55.1 |
| 5,642,981 | A | | 7/1997 | Kato et al. | 415/55.1 |
| 5,680,700 | A | * | 10/1997 | Tuckey | 415/55.1 |
| 5,716,191 | A | | 2/1998 | Ito et al. | 415/55.4 |
| 5,762,469 | A | * | 6/1998 | Yu | 415/55.1 |
| 6,113,363 | A | * | 9/2000 | Talaski | 415/55.1 |
| 6,224,323 | B1 | * | 5/2001 | Murase et al. | 415/55.1 |

FOREIGN PATENT DOCUMENTS

WO WO 96/24769 8/1996

* cited by examiner

*Primary Examiner*—F. Daniel Lopez
*Assistant Examiner*—Richard Woo
(74) *Attorney, Agent, or Firm*—Reising, Ethington, Barnes, Kisselle, Learman & McCulloch, P.C.

(57) ABSTRACT

An electric motor turbine-type fuel pump having a pair of substantially separate fuel pumping channels on opposed faces of an impeller which has a plurality of circumferentially spaced vanes disposed about the periphery of the impeller. The tip portion of each vane is generally arcuate or curved such that a radially outermost edge of the tip is forward or leads the corresponding radially innermost edge of its base relative to the direction of rotation of the impeller. Preferably, each vane is defined between a pair of radially, axially, and circumferentially extending pockets formed in the impeller, with one set of vanes opening to each of a pair of opposed side faces of the impeller. An axially centered, circumferentially extending rib extends to the radially outermost portion of the vanes and separates the vanes on one face of the impeller from the vanes on the opposed face of the impeller. The center rib communicates with a complementary rib of a guide ring in which the impeller is received in assembly of the fuel pump to also separate the pair of fuel pumping channels from each other. The orientation of the vanes within the split or separated fuel pumping channels dramatically increases the efficiency of the fuel pump, especially during the condition of low fuel pump motor speeds and low fuel flow rate conditions in the fuel pump. Desirably, this will, for example, improve the cold starting of an engine utilizing the fuel pump.

24 Claims, 5 Drawing Sheets

TURBINE FUEL PUMP

FIELD OF THE INVENTION

This invention relates generally to a fuel pump and more particularly to a regenerative or turbine type fuel pump.

BACKGROUND OF THE INVENTION

Electric motor fuel pumps have been widely used to supply the fuel demand for an operating engine such as in automotive applications. These pumps may be mounted directly within a fuel supply tank with an inlet for drawing liquid fuel from the surrounding tank and an outlet for delivering fuel under pressure to the engine. The electric motor includes a rotor mounted for rotation within a stator in a housing and connected to a source of electrical power for driving the rotor about its axis of rotation. In the pump, an impeller is coupled to the rotor for co-rotation with the rotor and has a circumferential array of vanes about the periphery of the impeller. One example of a turbine fuel pump of this type is illustrated in U.S. Pat. No. 5,257,916.

Conventional fuel pump impellers have vanes which are generally flat, straight and radially outwardly extending. Other impeller vanes have been flat, straight and canted relative to a radius of the impeller. With this general configuration, previous fuel pumps have had an efficiency of approximately 20% to 30% and when combined with an electric motor having a 45% to 50% efficiency, the overall efficiency of such electric motor turbine-type fuel pumps is between about 10% to 15%. Thus, there is the continuing need to improve the design and construction of such fuel pumps to increase their efficiency.

U.S. Pat. No. 5,642,981 (the '981 patent) discloses an open channel fuel pump with an impeller and various vane shapes and configurations for the impeller. In FIG. 13E, a vane is shown which has a base portion extending radially from a body of the impeller over a length of approximately 80% of the total length of the vane, and a tip portion extending from the base portion which is curved or arcuate so that the tip portion leads the base portion in the direction of rotation of the impeller. The open channel pump design communicates pockets between adjacent vanes, that are formed on each of the opposed faces of the impeller, with each other.

SUMMARY OF THE INVENTION

An electric motor turbine-type fuel pump having a pair of substantially separate fuel pumping channels on opposed faces of an impeller which has a plurality of circumferentially spaced vanes disposed about the periphery of the impeller. Each vane has a base portion extending essentially radially outwardly from a main body of the impeller and a tip portion extending from the base portion. The tip portion of each vane is generally arcuate or curved such that a radially outermost edge of the tip is forward of or leads the corresponding radially innermost edge of its base relative to the direction of rotation of the impeller. Preferably, each vane is defined between a pair of radially, axially, and circumferentially extending pockets formed in the impeller, with one set of vanes opening to each of a pair of opposed side faces of the impeller. An axially centered, circumferentially extending rib extends to the radially outermost portion of the vanes and separates the vanes on one face of the impeller from the vanes on the opposed face of the impeller. The center rib communicates with a complementary rib of a guide ring in which the impeller is received in assembly of the fuel pump to also separate the pair of fuel pumping channels from each other. The orientation of the vanes within the split or separated fuel pumping channels dramatically increases the efficiency of the fuel pump, especially during conditions of low fuel pump motor speeds and low fuel flow rate conditions in the fuel pump. Desirably, this will, for example, improve the cold starting of an engine utilizing the fuel pump.

Objects, features and advantages of this invention include providing an improved impeller for a turbine-type fuel pump which improves the efficiency of the fuel pump, improves the circulation of fuel through a pair of pumping channels defined about the periphery and adjacent opposed faces of the impeller, can be used with existing fuel pump designs, has dramatically improved performance at low fuel pump motor speeds and low fuel flow rates, improves cold starting of an engine to which it supplies fuel, is rugged, durable, of relatively simple design and economical manufacture and assembly and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
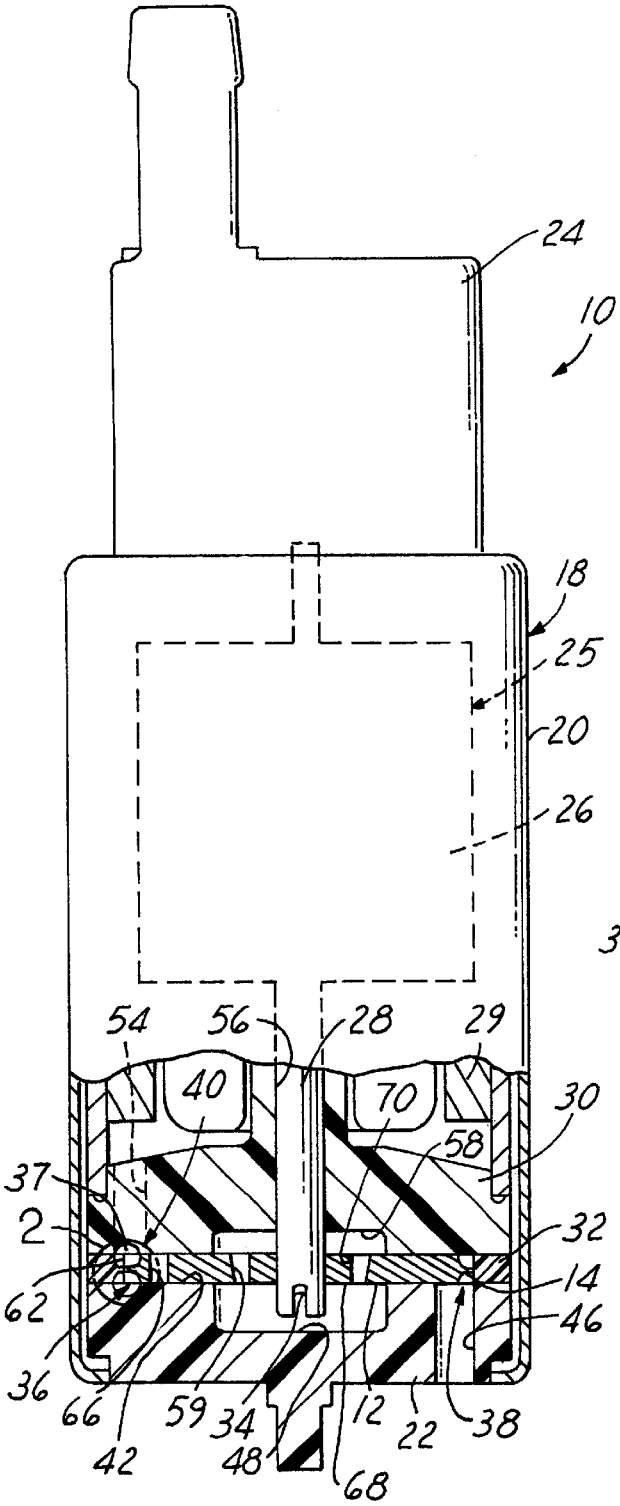
FIG. 1 is a side view with portions broken away and in section of an electric motor turbine-type fuel pump having an impeller embodying the present invention.
Figure 2:
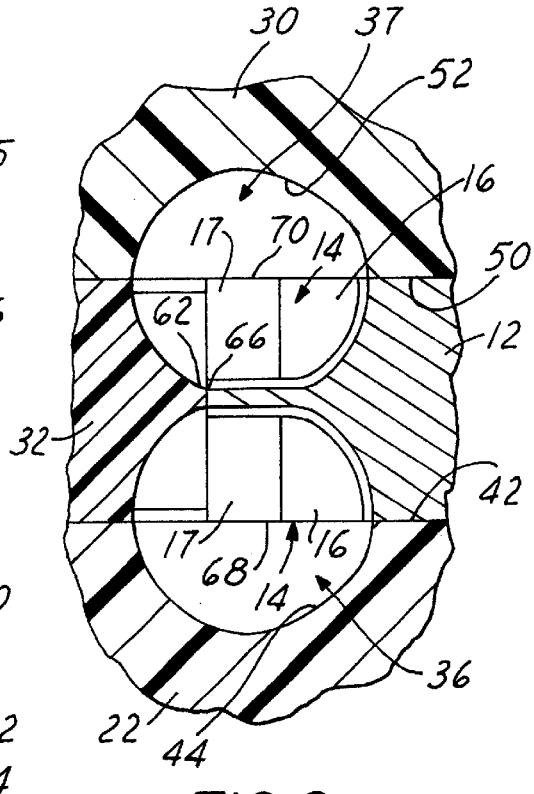
FIG. 2 is a fragmentary sectional view of the encircled portion 2 of the fuel pump of FIG. 1 taken along a line to illustrate a vane on each of the opposed faces of the impeller.

Referring in more detail to the drawings, FIGS. 1 and 2 illustrate a dual or split channel turbine-type fuel pump 10 having a circular impeller 12 embodying the present invention with a circumferential array of vanes 14 each having a base 16 extending radially from the body of the impeller 12 and leading to a tip 17 which is curved or arcuate so that it leads the base relative to the direction of rotation of the impeller. The fuel pump 10 has a housing 18 formed by a cylindrical case 20 that joins axially spaced apart inlet 22 and outlet 24 end caps. The impeller is driven by an electric motor 25 having a rotor 26 journalled by a shaft 28 for rotation within a surrounding permanent magnet stator 29 both received in the housing 18. The rotor 26 is coupled to the impeller 12 which is disposed between the inlet end cap 22 and an upper pump body 30 and within a guide ring 32 encircling the impeller. The impeller 12 is coupled to the shaft 28 by a wire clip 34 for corotation with the shaft 28. A pair of substantially separate arcuate pumping channels 36, 37 are defined about the periphery of the impeller 12, with one on each of a pair of opposed faces of the impeller, by the inlet end cap 22, upper pump body 30 and the ring 32. The pumping channels 36, 37 have an inlet port 38 into which fuel is drawn and an outlet port 40 through which fuel is discharged into the housing 18 under pressure. With the exception of the impeller 12, and as otherwise noted herein, the fuel pump 10 is preferably constructed in accordance with U.S. Pat. No. 5,586,858, the disclosure of which is incorporated herein by reference in its entirety.

Figure 4:
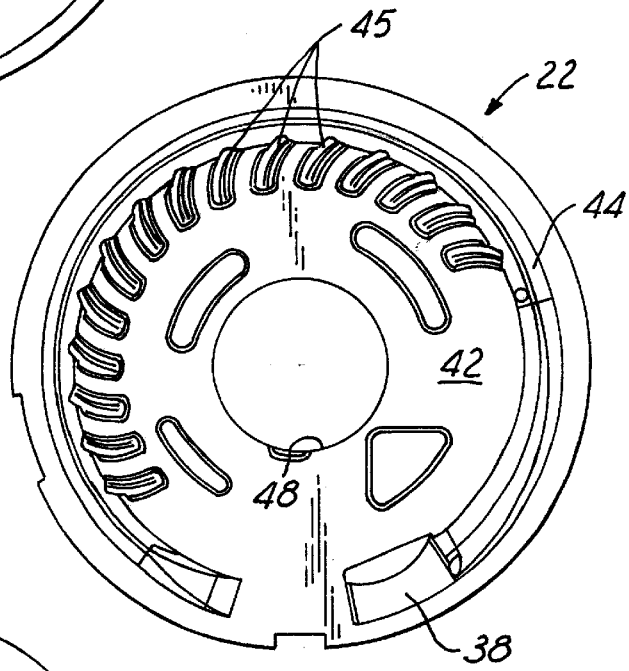
FIG. 4 is a plan view of an inlet end cap of the fuel pump.

As shown in FIG. 4, the inlet end cap 22 has a flat upper face 42 and an arcuate groove 44 formed therein which defines in part the pumping channel 36. Arcuate recesses 45 may be provided radially inwardly of and opening into the groove 44. An inlet passage 46 through the inlet end cap 22 communicates with the inlet port 38 of the pumping channel 36. A central blind bore 48 provides clearance for the shaft 28 and clip 34.

Figure 5:
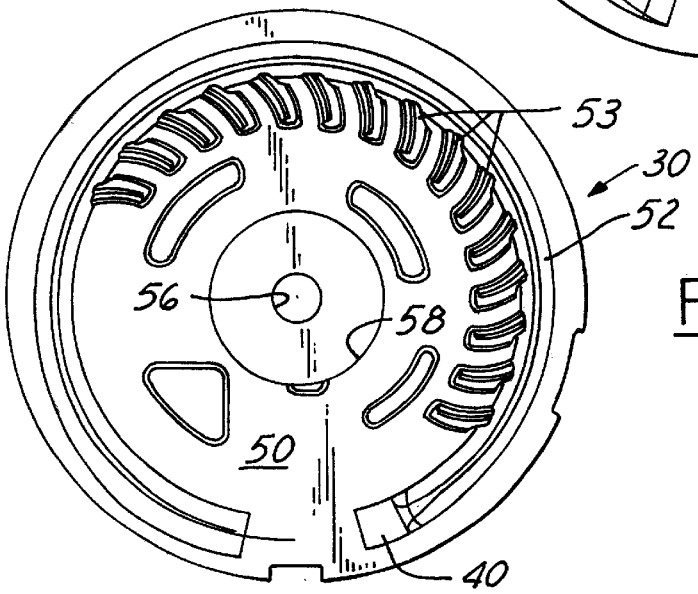
FIG. 5 is a view of a bottom surface of an upper pump body of the fuel pump.

As show in FIG. 5, the upper pump body 30 has a flat lower face 50 adjacent the impeller 12 and an arcuate groove 52 formed therein defining in part the pumping channel 37. Arcuate recesses may be provided radially inwardly of and opening into the groove 52. An outlet passage 54 through the body communicates the outlet port 40 of the pumping channel 37 with the interior of the housing 18. A central through bore 56 receives the shaft 28 and a counterbore 58 provides clearance for the clip 34 which may extend through holes 59 in the impeller 12. The holes 59 also equalize the pressure across the portion of the impeller within the bore 48 and counterbore 58. The recesses may be formed in accordance with U.S. Pat. No. 5,257,916, the disclosure of which is incorporated herein by reference in its entirety.

Figure 3:
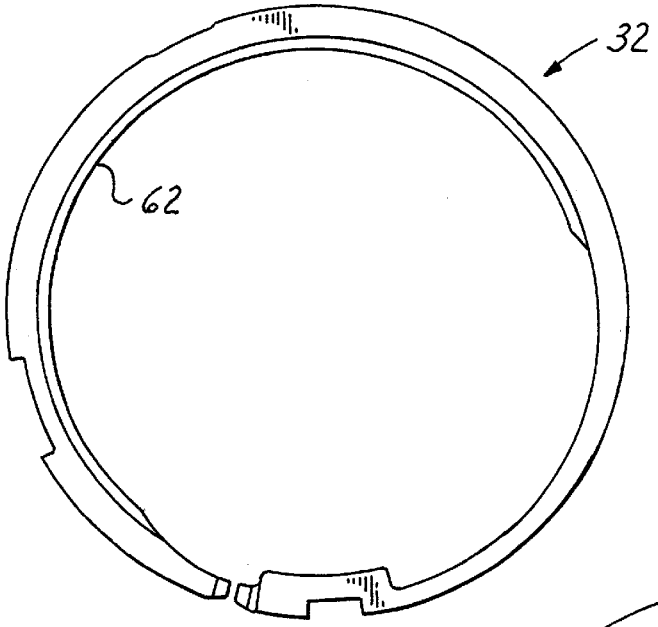
FIG. 3 is a perspective view of a guide ring of the fuel pump of FIG. 1.

As shown in FIG. 1, the ring 32 is clamped between the inlet end cap 22 and the upper pump body 30. As shown in FIGS. 2 and 3, the ring 32 has a centrally disposed and radially inwardly extending rib 62 spanning a substantial arcuate extent of the impeller 12 between the inlet and outlet of the channels. The inlet end cap 22, pump body 30 and ring 32 may be substantially as described in U.S. Pat. No. 5,680,700 the disclosure of which is incorporated herein by reference in its entirety.

As best shown in FIGS. 1, and 6–8, the impeller 12 has a disc body 63 with a central hole 64 through which the shaft 28 is received, a circumferential array of angularly spaced and generally radially and axially extending vanes 14, in two sets with one set on each of the pair of opposed axial faces 68, 70 of the impeller 12. Each vane has axially extending leading and trailing faces 65, 67 and is defined by a pair of axially, circumferentially and radially extending cavities or pockets 71 formed in the faces 68, 70 of the impeller. The pockets 71 and vanes 14 associated with one face 68 are preferably circumferentially offset or staggered relative to the pockets 71 and vanes 14 associated with the other face 70, although they may be aligned if desired. The pockets 71 have a pair of arcuate transition portions 73 each leading to an arcuate bottom wall 75 of the pocket 71. In cooperation with the vanes 14, the pockets 71 define a circumferentially continuous rib 66 centered between the opposed axial faces 68, 70 of the impeller 12 and extending radially outwardly from the body to the same extent as the tips 17 of the vanes 14. So constructed, as shown in FIGS. 1 and 2, the rib 66 of the impeller 12 and the rib 62 of the ring 32 separate the fuel pumping higher pressure channels 36, 37 from each other with one channel 36, 37 on each face 68, 70 of the impeller, respectively.

Figure 13:
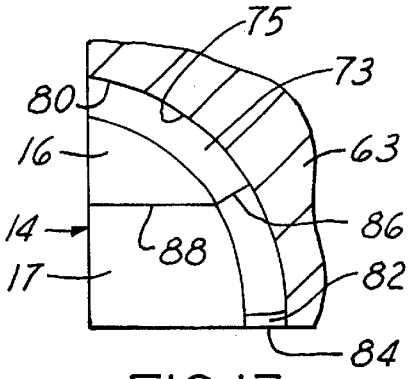
FIG. 13 is a sectional view taken along line 13—13 of FIG. 9.

As best shown in FIGS. 9–13, and particularly FIG. 13, the bottom wall 75 of each pocket 71 extends along a preferably smooth arc from the radially innermost edge 80 of the pockets 71 to a break line 81 defining the beginning of an outer edge portion 82 extending to the radially outermost edge 84 of the pockets 71 at the periphery of the impeller 12. The outer edge portion 82 is preferably generally planar or flat, extends to the periphery of the impeller 12 generally perpendicular to the axis of rotation of the impeller 12 and defines in part the rib 66. The impellers 12 are typically machined after they are formed to remove a parting line or other inconsistencies at the periphery of the impeller. Therefore, providing the generally flat outer edge portion 82 facilitates matching up the impeller 12 with adjacent pump components and specifically, facilitates axially aligning the rib 66, after some of the material at the periphery of the impeller 12 has been removed by the machining process. Due to the arcuate bottom wall 75, each vane 14 has its shortest axial height adjacent to the radially innermost edge 80 of its adjacent pocket 71 and its greatest axial height adjacent to the radially outermost edge 84 of its adjacent pocket 71.

Figure 8:
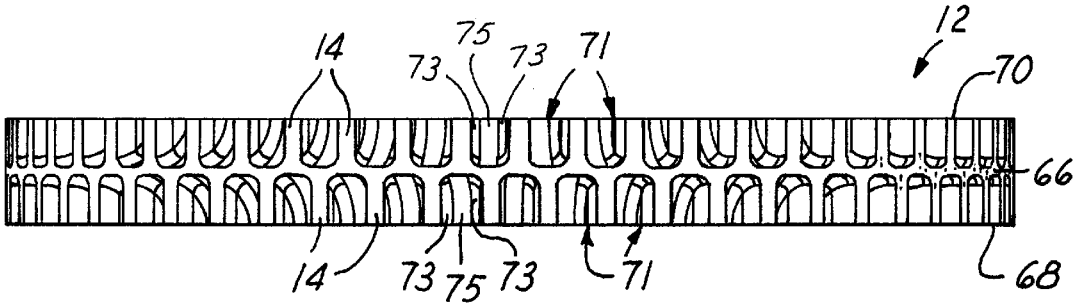
FIG. 8 is an end view of the impeller.

As best shown in FIGS. 9–14, the transition portions 73 have a generally consistent circumferential width and axial height along the radial extent of each vane 14 to provide a smooth, arcuate transition from the axially extending side faces 65, 67 of each vane 14 to the arcuate bottom wall 75 which extends generally transversely relative to the side faces 65, 67 of the vanes 14. So formed, the transition portions 73 and vanes 14 provide a generally U-shaped pocket 71 when viewed radially inwardly from the periphery of the impeller as shown in FIG. 8. The transition portions 73 provide a smoother fluid flow in the pockets 71 to reduce flow losses as the fuel is moved and displaced within the pocket 71. Without the transition portions 73, greater flow losses would occur due to the generally transverse orientation of the bottom wall 75 with respect to the side faces 65, 67 of the vanes 14. The bottom wall 75 and transition portions 73 extend radially outwardly from their radially inner edge 80 for a predetermined distance corresponding to the base portion 16 of the adjacent vanes 14 to a breakline 86 and then they are generally arcuate or curved to the periphery of the impeller 12 corresponding to the tip 17 of the vanes 14 as described hereinafter with reference to the vanes 14 which are each defined between adjacent pockets 71.

Figure 6:
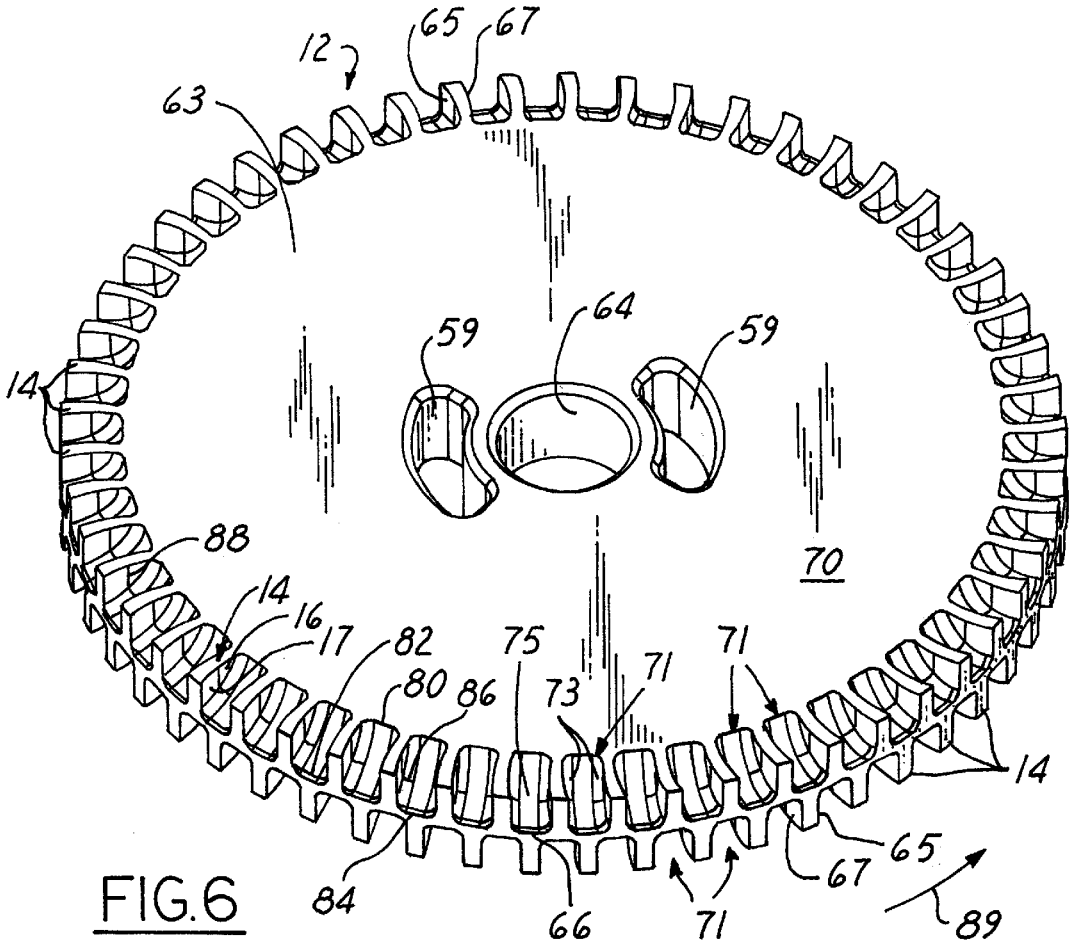
FIG. 6 is a perspective view of the impeller.
Figure 7:
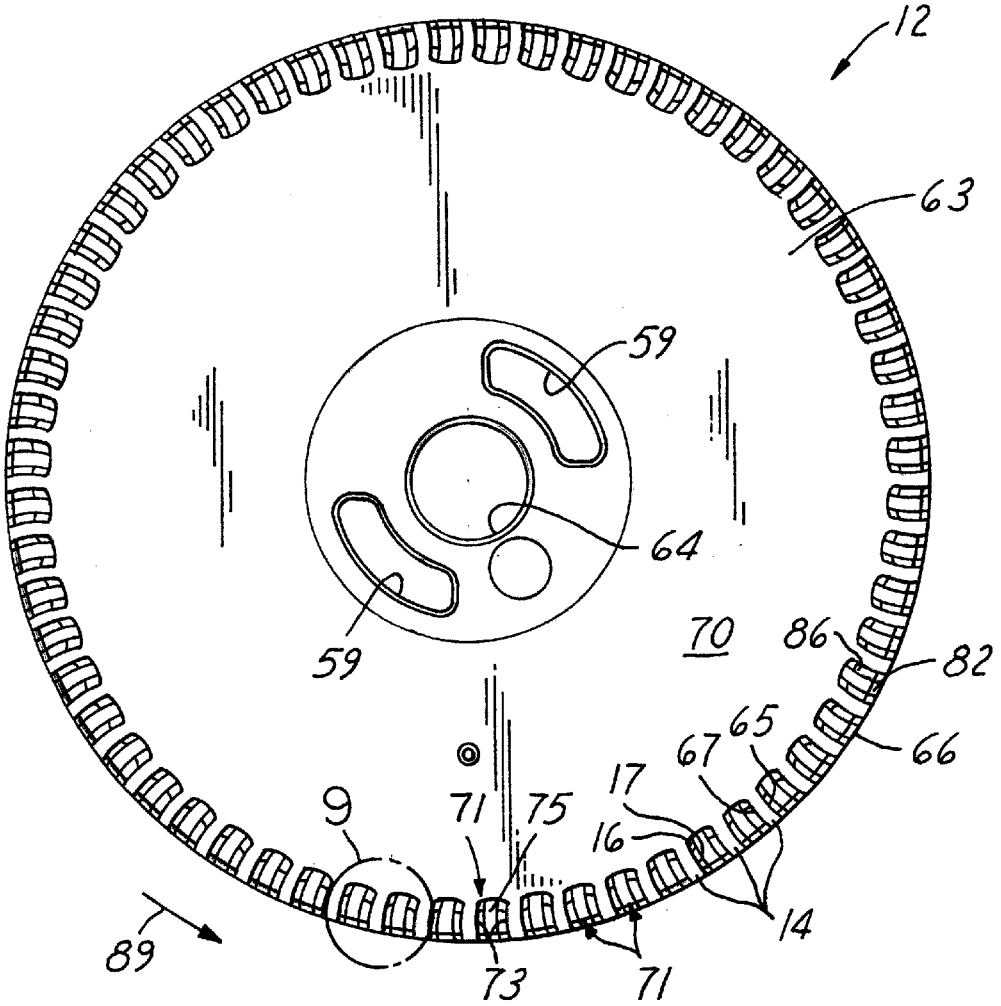
FIG. 7 is a plan view of the impeller.
Figure 9:
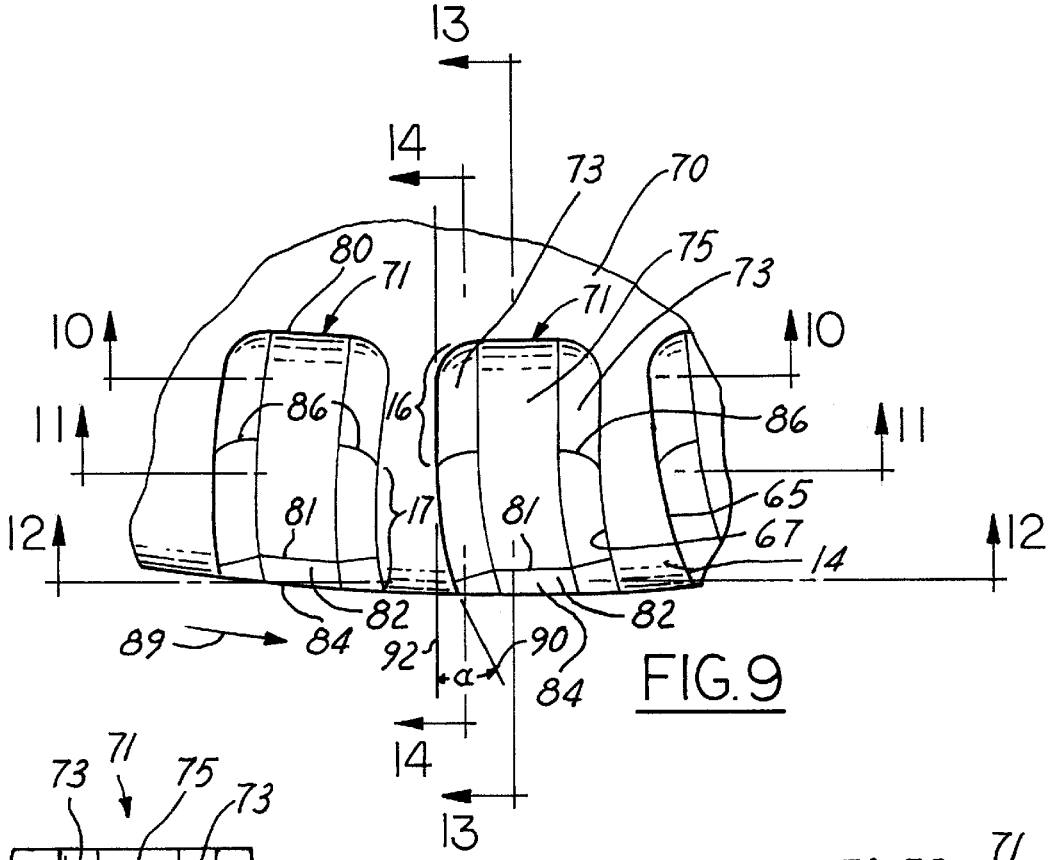
FIG. 9 is an enlarged fragmentary view of the encircled portion 9 of FIG. 7.
Figure 10:
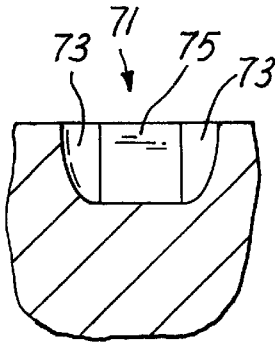
FIG. 10 is a sectional view taken along line 10—10 of FIG. 9.
Figure 11:
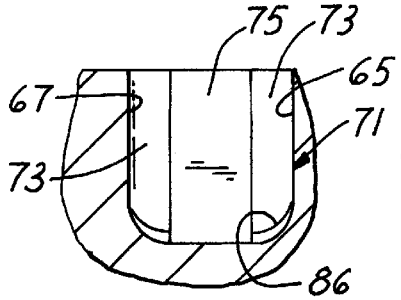
FIG. 11 is a sectional view taken along line 11—11 of FIG. 9.
Figure 12:
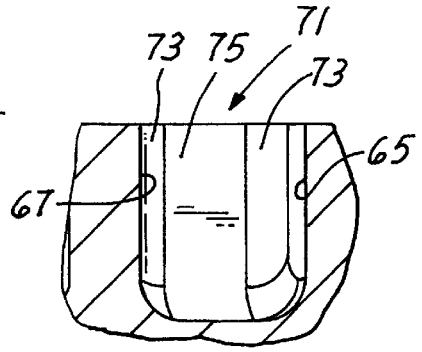
FIG. 12 is a sectional view taken along line 12—12 of FIG. 9.
Figure 14:
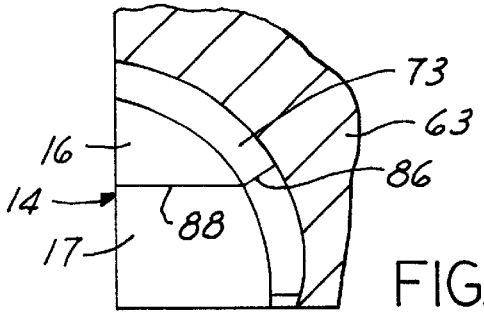
FIG. 14 is a sectional view taken along line 14—14 of FIG. 9.

As best shown in FIGS. 6–9, each vane 14 has a pair of side faces including the axially extending leading or front face 65 and the trailing face 67. A base portion 16 of each vane is operably connected to and preferably integral with the impeller 63, and a free end or tip 17 extends from the base portion 16 to the periphery of the impeller. The base portion 16 of each vane 14 extends from the body 63 in an essentially straight, radial direction. The tip 17 extends from the base 16 and is generally arcuate or curved so that the tip 17 leads the base 16 in the direction of rotation of the impeller 12 indicated by arrow 89 (FIGS. 6, 7 and 9). Preferably, the essentially straight, radial base portion 16 comprises about 30% to 70% of the total length of each vane 14, and the tip 17 comprises the remaining 70% to 30% of the total length of each vane. As shown in FIGS. 13 and 14, the transition between base 16 and tip 17 is indicated at break line 88 in the drawings, which corresponds to the break line 86 of the transition portions 73.

As shown in FIG. 9, the tip 17 of each vane 14 is curved such that a line 90 tangent to the radially outermost point of the leading face 65 of the vane on face 70 of the impeller 12 is inclined relative to a radius 92 of the impeller extending coincident to the leading face 65 of the base portion 16 of the vane 14 is at an acute included angle $\alpha$ of between 10 degrees and 40 degrees, and preferably between 15 degrees and 35 degrees. Desirably, the tip 17 is curved about a consistent, smooth radius to blend into the base portion 16. Also, as best shown in FIGS. 6, 7 and 9, to maintain the width of the pockets 71 between the vanes 14 generally constant from their radially inner edges 80 at the bases 16 of the vanes 14 to their radially outer edges 84 at the periphery of the impeller 12, the vanes 14 become thicker or wider from their base 16 to their tips 17.

In operation, as the rotor 26 drives the impeller 12 for rotation within the ring 32 and pumping channels 36, 37, liquid fuel is drawn into the inlet port 38 of the pumping channels 36, 37 whereupon it is moved circumferentially through the pumping channels 36, 37 and is discharged under pressure through the outlet port 40. The pressure of the fuel is increased which is believed to be due to a vortex-like pumping action imparted to the liquid fuel by the impeller 12. The liquid fuel enters the pockets 71 between adjacent vanes 14 of the impeller 12 both axially, such as from the grooves 44 and 52 formed in both the inlet end cap 22 and the upper pump body 30, and radially, from between the impeller 12 and the ring 32. The preferably generally arcuate shape of the vanes 14 over the tip portion 17 of their radial extents and along their axial extents, provides a partially curved vane 14 to direct the liquid fuel discharged from a pocket 71 forward relative to the direction of rotation of the impeller 12.

With this improved impeller 12 construction, the overall efficiency and the flow rate at low fuel pump motor speeds are dramatically improved. Comparative testing of fuel pumps having conventional, straight, radially extending blades and fuel pumps having impellers constructed in accordance with this invention illustrates the dramatic improvement. For a fuel pump operated at 7 volts, 4.5 amps, and an output pressure of 300 kpa, the flow rate from the conventional fuel pumps was, on average, about 43.1 liters per hour, for an overall fuel pump efficiency, including the electric motor efficiency of 11.3%. For fuel pumps having impellers according to the present invention and operated under the same conditions, the flow rate increased to over 51 liters per hour on average, with one pump producing over 55.9 liters per hour, for an average overall efficiency of 13.4%. Thus, for the noted operating characteristics, the fuel pumps having impellers according to the present invention were over 18.5% more efficient than the conventional fuel pumps. Other empirical data and analysis has shown an improvement in overall efficiency of the fuel pump 10 over a wide range of operating conditions by about 10% to 25%.

What is claimed is:

1. A turbine type pump, comprising:

a fuel pump housing;

a circular impeller body carried in the housing, constructed to rotate about an axis and having a pair of generally axially opposed faces;

a pair of substantially separate fluid pumping channels defined in the housing with one fluid pumping channel adjacent to each of the axially opposed faces of the impeller body;

a plurality of circumferentially spaced vanes extending from the periphery of the impeller body on each of the axially opposed faces of the impeller body with pockets between adjacent vanes and the vanes on each face of the impeller body extending into a corresponding one of the fluid pumping channels, each vane having a base portion extending essentially radially from the impeller body, and an arcuate tip extending from the base portion at an orientation such that the tip leads the base portion in the direction of rotation of the impeller body the pockets on one face do not communicate through the impeller with the pocket on the other face; and a circumferentially continuous rib of the impeller body extending to the periphery of the impeller body, separating pockets between the vanes in one face of the impeller body from pockets between the vanes in the other face of the impeller body, and disposed adjacent to a circumferentially extending portion of the housing to separate the fluid pumping channels at least along the circumferential extent of said portion of the housing.

2. The pump of claim 1 wherein the base portion of each vane comprises between 30% to 70% of the total length of the vane.

3. The pump of claim 1 wherein an included angle $\alpha$ defined between a line tangent to the tip at a radially outermost edge of the tip of a vane and a radius of the impeller extending through a corresponding radially innermost edge of the base of the vane is between 10° and 40°.

4. The pump of claim 1 wherein an included angle $\alpha$ defined between a line tangent to the tip at a radially outermost edge of the tip of a vane and a radius of the impeller extending through a corresponding radially innermost edge of the base of the vane is between 20° and 30°.

5. The pump of claim 1 which also comprises an end cap, a pump body and a ring disposed between the end cap and pump body and having a circumferentially extending rib defining the circumferentially extending portion of the housing with one of the fluid pumping channels defined between the end cap, ring and impeller body and the other of the fluid pumping channels defined between the pump body, ring and the impeller body.

6. The pump of claim 1 wherein each pocket has generally opposed, sloped sidewalls with one sidewall defining a leading edge of one vane and the other sidewall defining the trailing edge of an adjacent vane, and each sidewall slopes inwardly to a bottom wall defining in part the rib of the impeller body.

7. The pump of claim 1 wherein the tip of each vane is arcuate along its axial extent.

8. The pump of claim 1 wherein each pocket has a pair of sidewalls with one sidewall defining a leading edge of one vane and the other sidewall defining a trailing edge of an adjacent vane and a bottom wall defining in part the rib of the impeller body and the bottom wall being arcuate from the radially innermost edge of the pocket to adjacent the radially outermost edge of the pocket.

9. The pump of claim 8 wherein each pocket has an arcuate transition portion between each sidewall and the bottom wall.

10. The pump of claim 8 wherein the bottom wall of each pocket at the periphery of the impeller body has a planar surface which joins the arcuate portion of the bottom wall.

11. The pump of claim 10 wherein each pocket has an arcuate transition portion between each sidewall and the bottom wall.

12. The pump of claim 8 wherein the width of each pocket between its pair of sidewalls is substantially constant from adjacent the radially inner edge of the pocket to the radially outer edge of the pocket.

13. An electric motor turbine type pump comprising:

a housing having an inlet end cap defining at least in part an inlet of the pump through which a fluid is drawn, a pump body defining at least in part an outlet through which fluid is discharged under pressure and a pair of substantially separate fluid pumping channels each communicating with the inlet and the outlet;

an electric motor including a rotor journalled for rotation within the housing;

an impeller coupled to the rotor for co-rotation therewith and having a plurality of circumferentially spaced vanes extending from the periphery of the impeller body on each of the axially opposed faces of the impeller body with pockets between adjacent vanes and the vanes on each face of the impeller body extending into a corresponding one of the fluid pumping channels, each vane having a base portion extending essentially radially from the impeller body, and an arcuate tip extending from the base portion at an orientation such that the tip leads the base portion in the direction of rotation of the impeller body the pockets on one face do not communicate through the impeller with the pockets on the other face, whereby, the electric motor drives the rotor for rotation which in turn drives the impeller for rotation to draw fluid into the inlet, increase the pressure of the fluid in the fluid pumping channels and then discharge the fluid under pressure through the outlet; and a circumferentially continuous rib of the impeller body extending to the periphery of the impeller body, separating pockets between the vanes in one face of the impeller body from pockets between the vanes in the other face of the impeller body, and disposed adjacent to a circumferentially extending portion of the housing to separate the fluid pumping channels at least along the circumferential extent of said portion of the housing.

14. The pump of claim 13 wherein the base portion of each vane comprises between 30% to 70% of the total length of the vane.

15. The pump of claim 13 wherein an included angle a defined between a line tangent to the tip at a radially outermost edge of the tip of a vane and a radius of the impeller extending through a corresponding radially innermost edge of the base of the vane is between 10° and 40°.

16. The pump of claim 13 wherein an included angle $\alpha$ defined between a line tangent to the tip at a radially outermost edge of the tip of a vane and a radius of the impeller extending through a corresponding radially innermost edge of the base of the vane is between 20° and 30°.

17. The pump of claim 13 which also comprises a ring disposed between the end cap and pump body and having a circumferentially extending rib defining the circumferentially extending portion of the housing with one of the fluid pumping channels defined between the end cap, ring and impeller body and the other of the fluid pumping channels defined between the pump body, ring and the impeller body.

18. The pump of claim 13 wherein each vane is defined between a pair of pockets formed in an axial face of the impeller body.

19. The pump of claim 18 wherein each pocket has generally opposed, sloped sidewalls with one sidewall defining a leading edge of one vane and the other sidewall defining the trailing edge of an adjacent vane, each sidewall slopes inwardly to a bottom wall defining in part the rib of the impeller body.

20. The pump of claim 13 wherein each pocket has a pair of sidewalls with one sidewall defining a leading edge of one vane and the other sidewall defining a trailing edge of an adjacent vane and a bottom wall defining in part the rib of the impeller body and the bottom wall being arcuate from the radially innermost edge of the pocket to adjacent the radially outermost edge of the pocket.

21. The pump of claim 20 wherein each pocket has an arcuate transition portion between each sidewall and the bottom wall.

22. The pump of claim 20 wherein the bottom wall of each pocket at the periphery of the impeller body has a planar surface which joins the arcuate portion of the bottom wall.

23. The pump of claim 22 wherein each pocket has an arcuate transition portion between each sidewall and the bottom wall.

24. The pump of claim 20 wherein the width of each pocket between its pair of sidewalls is substantially constant from adjacent the radially inner edge of the pocket to the radially outer edge of the pocket.

* * * * *

UNITED STATES PATENT AND TRADEMARK OFFICE

CERTIFICATE OF CORRECTION

PATENT NO. : 6,425,733 B1
DATED : July 30, 2002
INVENTOR(S) : Joseph M. Ross

It is certified that error appears in the above-identified patent and that said Letters Patent is hereby corrected as shown below:

Column 6,
Line 14, after "body" insert a comma (,).
Line 14, delete "pocket" and insert -- pockets --.

Column 7,
Line 26, after "body" insert a comma (,).
Line 45, delete "angle a" and insert -- angle α --.

Signed and Sealed this

Fourth Day of February, 2003

JAMES E. ROGAN
*Director of the United States Patent and Trademark Office*